US005325572A

United States Patent [19]

Dickson, III et al.

[11] Patent Number: 5,325,572

[45] Date of Patent: Jul. 5, 1994

[54] YARN TREATING JET

[75] Inventors: Frederick S. Dickson, III, Hockessin; Perry H. Lin, Seaford; Norvel W. Orendorf, Georgetown, all of Del.

[73] Assignee: E. I. Du Pont de Nemours and Company, Wilmington, Del.

[21] Appl. No.: 903,091

[22] Filed: Jun. 23, 1992

[51] Int. Cl.[5] ..... D02G 1/16; D02J 1/08

[52] U.S. Cl. ..... 28/276; 28/271; 28/274; 28/275

[58] Field of Search ..... 28/273, 271, 274, 276, 28/275; 137/118

[56] References Cited

U.S. PATENT DOCUMENTS

| | | | |
|---|---|---|---|
| 2,938,256 | 5/1960 | Bauer et al. | 28/271 |
| 3,261,071 | 7/1966 | Clendening et al. | 28/271 |
| 3,324,526 | 6/1967 | Burns et al. | 28/271 |
| 3,525,134 | 8/1970 | Coon | 28/1.4 |
| 3,638,291 | 2/1972 | Yngve | 28/1.4 |
| 3,703,751 | 11/1972 | Bowen | 28/273 |
| 3,802,036 | 4/1974 | Parks | 28/271 |
| 3,811,260 | 5/1974 | Ohayon | 28/271 |
| 3,845,528 | 11/1974 | Vermeer et al. | 28/271 |
| 4,157,606 | 6/1979 | Loew | 28/273 |
| 4,282,637 | 8/1981 | Mosseri et al. | 28/273 X |
| 4,817,843 | 4/1989 | Sano | 28/271 |

FOREIGN PATENT DOCUMENTS

| | | | |
|---|---|---|---|
| 197608 | 8/1976 | Japan | 28/271 |

*Primary Examiner*—CLifford D. Crowder
*Assistant Examiner*—Bibhu Mohanty

[57] ABSTRACT

A yarn bulking jet has a particular arrangement of the yarn passage through the jet and the two fluid conduits for directing fluid to opposite sides of the yarn passing through the passage is capable of providing control for entangling the yarn by increasing or decreating fluid flow in one of the two fluid conduits.

2 Claims, 3 Drawing Sheets

YARN TREATING JET

BACKGROUND OF THE INVENTION

The invention relates to process and apparatus for treating synthetic filaments with hot gas or steam to introduce random curvilinear crimp of desired degrees and at the same time to introduce yarn bundle cohesion of desired degrees in filaments of various stiffnesses and cross-sectional shapes.

A number of different bulking jet designs have been disclosed for making bulked continuous filament products as disclosed in Breen and Lauterbach U.S. Pat. No. 3,638,291. Coon U.S. Pat. No. 3,525,134, which is incorporated herein by reference, employs a jet body having a passage extending along a straight axis through which yarn passes for treatment, a pair of angularly disposed conduits into the passage for directing fluid against opposite sides of the yarn, and fluid supply means connected to the conduits, one side of the passage and conduits being defined by the inner surface of a removable cap. The passage and conduits preferably have rectangular cross sections to minimize undesirable spiral fluid flow patterns which can twist the yarn erratically and produce zones of low bulk. Devices of the two references both gave greater degrees of filament entanglement and yarn bundle cohesion than those of earlier art along with a certain bulk level.

It is known, in general, that higher degrees of bulk may usually be obtained by raising the temperature and/or pressure of the bulking fluid, and that the degree of filament entanglement usually increases with higher fluid pressure. However, entanglement may become so high that the entwined filaments constrict the yarn bundle and reduce its bulk, such reduction usually is non-uniform along the length of the yarn and is considered as poor yarn quality.

The filament stiffness and cross sectional shapes affect the degrees of bulk and entanglement. For example, filaments having trilobal cross section have low torsional rigidity which permits them to more easily acquire the random filament twist and random curvilinear crimp characteristic of jet bulked products, and the higher surface area of trilobal filaments permits the high-velocity fluid to get a better grip on them. It is, therefore, relatively easy to obtain adequate bulk and excessive entanglement in trilobal filaments, particularly in those of high modification ratio. It would be desirable to reduce the entanglement while retaining bulk.

Conversely, filaments having a rounded square cross section with voids in each corner as disclosed in Champaneria and Lindbeck U.S. Pat. No. 3,745,061, FIG. 3, have higher torsional rigidity and have relatively less surface area for the fluid to act on, resulting in lower degrees of crimp and entanglement at the same fluid pressure and temperature conditions. Not only are these filaments more difficult to entangle than trilobal, their smooth exterior shape allows more of the entanglement to pull out under the tensions encountered when the yarns are wound on a package and are tufted into carpet backing. It would be desirable to obtain adequate bulk with increased entanglement.

Despite such problems, these and other filament shapes must be bulked and entangled by fiber manufacturers wishing to offer a wide range of carpet yarn products. While it is possible to design and fabricate bulking jets which give a specifically desired combination of crimp and entanglement for each product, the cost of providing an inventory of such jets and of losing production time while they are changed would be prohibitive. A means of obtaining desired combinations of bulk and entanglement from a single jet design with a minimum of change-over time and equipment cost would be greatly desired.

SUMMARY OF THE INVENTION

It has now been found that a bulking jet may be designed to give desired degrees of bulk to the most difficult fiber, such as the rounded square cross section with four voids, and at the same time a desired or excessive degree of entanglement, then reducing the degree of entanglement on products which are easier to entangle by reducing or increasing the flow in one of the two angularly disposed fluid conduits until a desired degree of entanglement is obtained, i.e., unbalancing the flow to vary the degree of entanglement. The degree of bulk is adjusted by changing the temperatures or pressure of the bulking fluid and/or the temperature of the yarn entering the jet.

The bulking jet of the invention comprises a body and cover clamped together by a fastener means, a longitudinal yarn passage recessed in the surface of the body contiguous with the cover, the yarn passage having tapered and semi-cylindrical lengths, a throat region and a continuously expanding treatment chamber, dual fluid conduits of equal rectangular cross-sectional area disposed on either side of the passage in the same plane as the treatment chamber and intersecting the throat region at a shallow angle, a bulking fluid supply manifold operatively connected to the fluid conduits and communicating with a source of pressurized fluid, such as hot air or steam, and a throat region having a width about 1.15–1.5 times the combined widths of the two fluid conduits. This permits adequate bulk to be obtained with adequate entanglement on yarn types which are difficult to entangle, while adequate bulk and excessive entanglement are obtained on yarns which are easy to entangle. The degree of entanglement is then reduced on these types by reducing the fluid flow in one of the two fluid conduits. This may be accomplished by providing an adjustable restriction such as a needle valve in the fluid supply to one or both of the two fluid supply conduits or by inserting a removable orifice therein. A device for restricting or increasing the flow of fluid in a conduit may conveniently be provided in the cover.

DESCRIPTION OF THE PREFERRED EMBODIMENT

Figure 1:
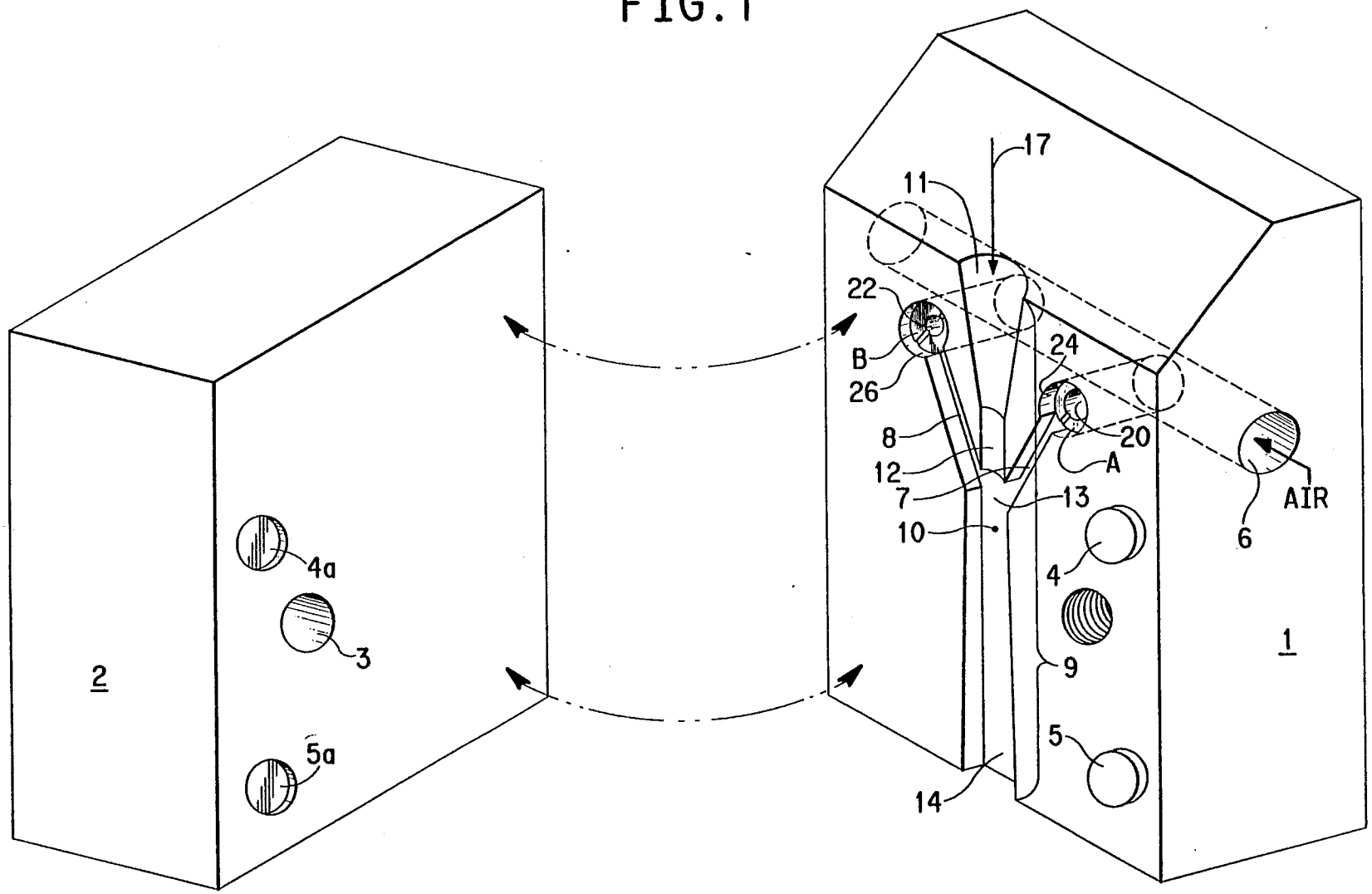
FIG. 1 is a schematic perspective drawing of one embodiment of the yarn bulking jet of the present invention with the cover removed.

As shown in the drawings, the device is composed of a body 1 and a detachable cover 2 which is secured to the body 1 by a conventional threaded fastener (not shown) which protrudes through aperture 3 provided for that purpose. A pair of locator dowel pins 4 and 5 in the body 1 engage matching cavities 4*a* and 5*a*, respectively, in the cover 2 and serve to align the cover and body. An internal supply manifold 6 within the body 1 furnishes pressurized treatment fluid to a pair of conduits 7 and 8 of equal cross-section which communicate with a longitudinal yarn passage 9. Fluid conduits 7 and 8 and treatment chamber 14 are rectangular cross-section cavities which are arranged so that their centerlines intersect at a common point 10 on the axis of passage 9. It is noted that any type treatment fluid such as condensing vapor or inert gas can be used with good effect and is supplied to manifold 6. In the present case, heated pressurized air is preferred.

Upstream of point 10, yarn passage 9 consists of a frusto-conical tapered length 11 to facilitate entrance of a moving yarn line 17, leading into a cylindrical length 12 of constant cross-section. Immediately thereafter, passage 9 abruptly forms a throat region 13 into which conduits 7 and 8 supply pressurized fluid.

Fluid conduits 7 and 8 have the same depth as throat region 13 and yarn treatment chamber 14 and lie in the same plane. Downstream of fluid channels 7 and 8, passage 9 becomes an elongated continuously expanding yarn treatment chamber 14. Chamber 14 must expand to establish and sustain supersonic flow of the treatment fluid.

Since entangling is performed chiefly by the components of fluid velocity which are directed perpendicularly to the yarn axis, it is important for maximum entangling that such perpendicular velocity components be as high as possible to exert maximum entangling force on the filaments. By the particular selection of dimensions of this invention, the fluid streams which have been traveling at sonic velocity through the conduits 7 and 8 become supersonic after they have passed the point of minimum throat area as disclosed in more detail in U.S. Pat. No. 3,525,134.

Figure 5:
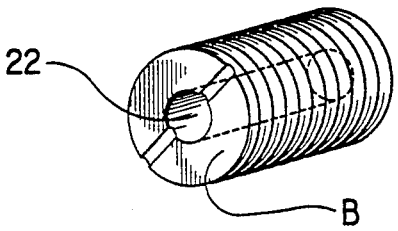
FIG. 5 is an enlarged perspective view of an orifice plug used with this invention.

One method of controlling flow of bulking fluid is by internally threading ports 22, 24 and inserting externally threaded plugs A and B. The diameter of the orifice at 20, 22 in plugs A and B, respectively, is selected to pass the particular flow rate desired. When two plugs A and B are used, orifice 20 is preferably larger than orifice 22. FIG. 5 is an enlarged view of one such plug.

Figure 2:
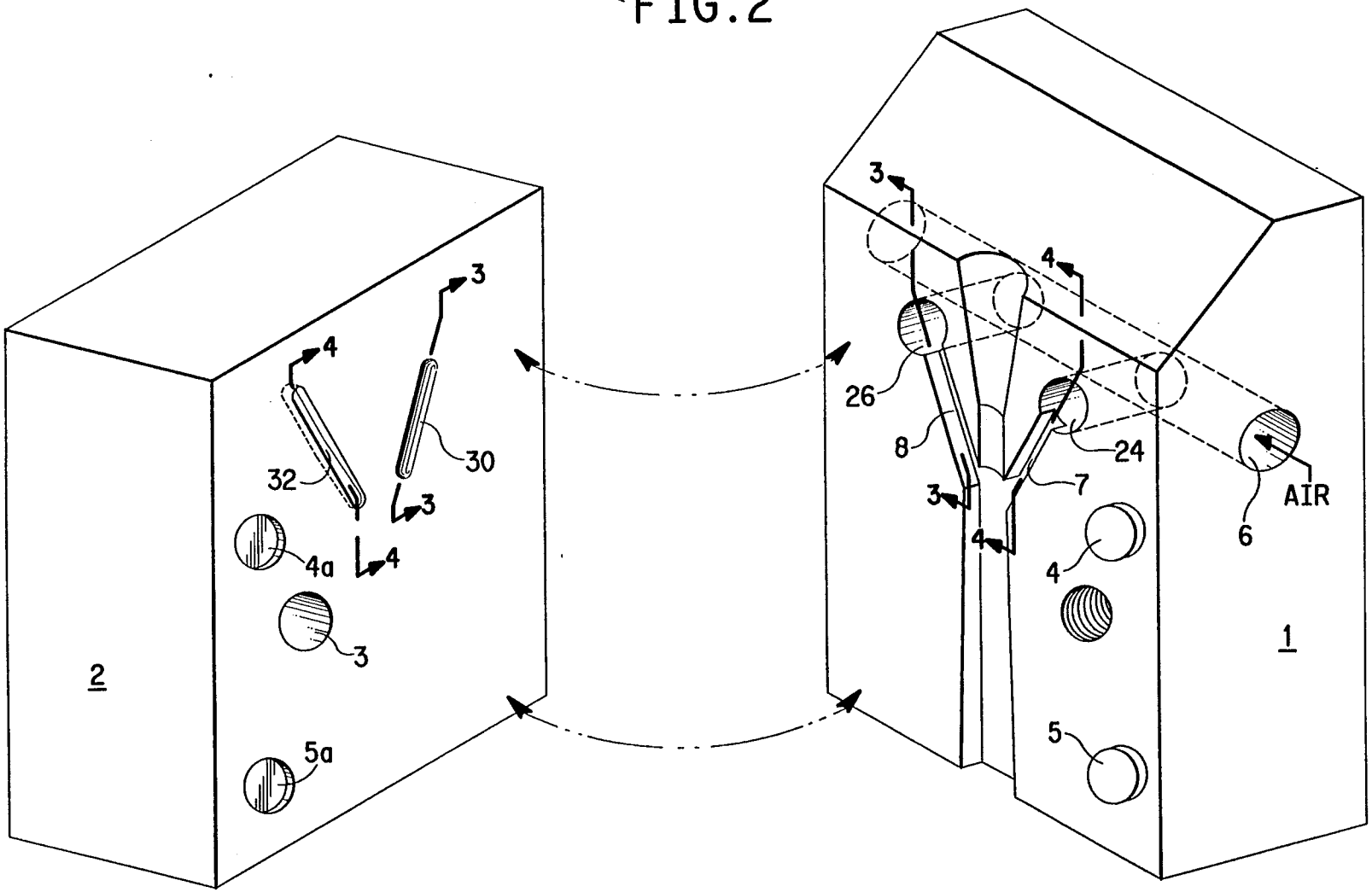
FIG. 2 is a schematic perspective drawing of another embodiment of the yarn bulking jet of the present invention with the cover removed.
Figure 3:
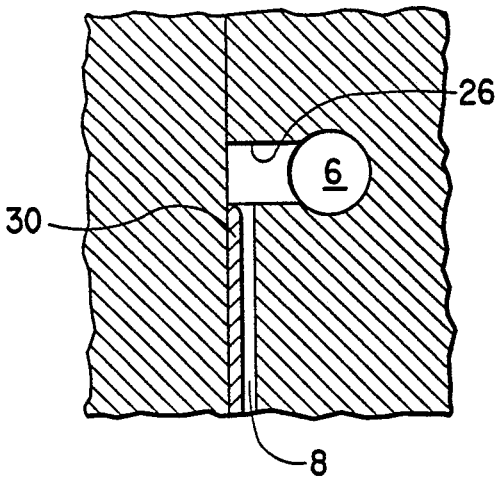
FIG. 3 is an enlarged sectioned view of FIG. 2 taken along lines 3—3 with the cover of the jet closed.

Referring to FIGS. 2 and 3, another method of controlling flow is by forming a restrictor or protrusion 30 on the surface of cover 12 that is positioned to fit into fluid conduit 8 and effectively reduce its cross-sectional area.

Figure 4:
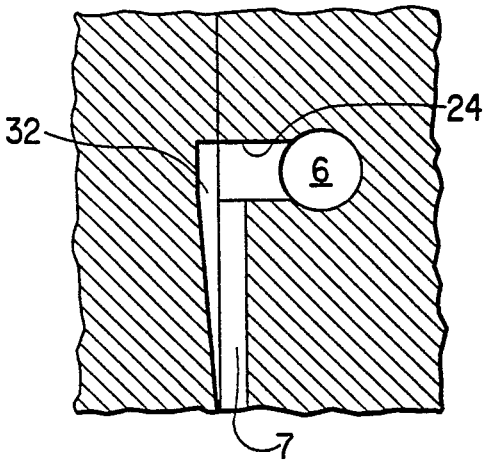
FIG. 4 is an enlarged sectioned view of FIG. 2 taken along lines 4—4 with the cover of the jet closed.

Alternatively, as shown in FIG. 4, a recess 32 cut into the cover effectively increases the nozzle discharge coefficient and, therefore, the flow through the passage. It is to be understood that any combination of the above may be effectively used.

An advantage in having caps specifically made for processing certain yarn products is that it is impossible for a machine operator to forget to remove or install a restricting device.

If a small degree of additional cohesion is needed in some products which are difficult to entangle or which easily lose cohesion upon tensioning, a yarn finish material which has low friction at high temperature and high friction at low temperature may be applied.

EXAMPLES

These examples illustrate adjusting the entanglement by varying the ratio of the two impingement flows using a jet similar to the one shown in FIG. 1.

EXAMPLE 1

A melt-spinning dope containing 12 melt flow index (MFI) polypropylene polymer and about 3% silver color concentrate was prepared by melting the polymer at 250° C. The melt-spinning dope was then spun at 3.2 grams/minute/hole through a spinneret. Referring to FIG. 1. the filaments passed from the spinneret into a quenching chimney at a rate of 45 filaments per end where a cooling gas was blown past the hot filaments at about 500 CFM flow rate. The filaments were pulled from the spinneret and through the quench zone by means of a feed roll rotating at 625 ypm. After quenching in air, the filaments were treated with spin-draw finish material at a finish roll. Next, filaments passed across a feed roll to heated (125° C.) draw rolls rotating at 1700 ypm. Following drawing, the heated filaments were crimped and entangled by the hot air jet similar to the one shown in FIG. 1 with air orifice A=0.065" and B=0 (single impingement). The bulking air temperature was 135° C. and bulking air pressure was 120 psi. The hot fluid exhausted with the threadlines against a rotating drum having a perforated surface on which the yarns were cooled to set the crimp. From the drum the threadlines in bulky form passed to a pair of driven take-up rolls onto rotating cores to form packages. The denier was about 1000. The filament cross-section was trilobal with a modification ratio of 2.9. Yarn entanglement measured by the Automatic Pin Drop Counter (APDC) described by Hitt in his U.S. Pat. No. 3,290,932 expressed as centimeters between stops of the device was 43 cm.

EXAMPLE 2

Polypropylene yarns were prepared using conditions described in Example 1 except that a bulking jet with air orifice dimension A=0.065" and B=0.020" was used. Yarn entanglement measured by APDC was 22 cm.

EXAMPLE 3

Polypropylene yarns were prepared using conditions described in Example 1 except that a bulking jet with air orifice dimension A=0.065" and B=0.032" was used. Yarn entanglement measured by APDC was about 6 cm.

EXAMPLE 4

Polypropylene yarns were prepared using conditions described in Example 1 except that a bulking jet with air orifice dimension A=0.065" and B=0.065" (balanced flow) was used. Yarn entanglement measured by APDC was about 2–3 cm.

What is claimed is:

1. A yarn bulking jet comprising: a body and a cover fastened together, said body having a longitudinal passage recessed in a surface of the body contiguous with said cover through which yarn passes for treatment; a pair of angularly disposed conduits recessed in said surface and in communication with said passage for directing fluid against opposite sides of the yarn and a protrusion formed on the surface of the cover that fits into one of said angularly disposed conduits to reduce the cross-sectional area of said one angularly disposed conduit.

2. A yarn bulking jet comprising: a body and a cover fastened together, said body having a longitudinal passage recessed in a surface on the body contiguous with said cover through which yarn passes for treatment; a pair of angularly disposed conduits recessed in said surface and in communication with said passage for directing fluid against opposite sides of the yarn and a recess formed in the surface of the cover for mating with one of said angularly disposed conduits to enlarge the cross-sectional area of said one angularly disposed conduit.

* * * * *